US007874654B2

(12) United States Patent
Nikkel et al.

(10) Patent No.: US 7,874,654 B2
(45) Date of Patent: Jan. 25, 2011

(54) FLUID MANIFOLD FOR FLUID EJECTION DEVICE

(75) Inventors: Eric L. Nikkel, Corvallis, OR (US); Chien-Hua Chen, Corvallis, OR (US); Tracy B. Forrest, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 894 days.

(21) Appl. No.: 11/818,314

(22) Filed: Jun. 14, 2007

(65) Prior Publication Data

US 2008/0309743 A1 Dec. 18, 2008

(51) Int. Cl.
*B41J 2/045* (2006.01)

(52) U.S. Cl. ..... 347/71

(58) Field of Classification Search ..... 347/56, 347/65, 66, 71
See application file for complete search history.

(56) References Cited

U.S. PATENT DOCUMENTS

| | | | | |
|---|---|---|---|---|
| 3,747,120 | A | 7/1973 | Stemme | |
| 4,396,924 | A | 8/1983 | Rosenstock | |
| 4,605,939 | A | 8/1986 | Hubbard et al. | |
| 4,771,298 | A | 9/1988 | Lee et al. | |
| 4,789,871 | A | 12/1988 | Uddgren | |
| 5,666,140 | A | 9/1997 | Mitani et al. | |
| 5,815,173 | A | 9/1998 | Silverbrook | |
| 5,907,337 | A | 5/1999 | Tajika et al. | |
| 5,966,148 | A | 10/1999 | Rogers et al. | |
| 6,027,207 | A | 2/2000 | Reinten et al. | |
| 6,045,214 | A | 4/2000 | Murthy et al. | |
| 6,139,132 | A * | 10/2000 | Yasukawa et al. | 347/70 |
| 6,264,313 | B1 | 7/2001 | Mackowiak et al. | |
| 6,322,206 | B1 * | 11/2001 | Boyd et al. | 347/85 |
| 6,692,113 | B2 | 2/2004 | Silverbrook et al. | |
| 6,767,089 | B2 * | 7/2004 | Buswell et al. | 347/86 |
| 6,804,885 | B2 | 10/2004 | Kishima | |
| 6,994,428 | B2 | 2/2006 | Ito | |
| 6,997,625 | B2 | 2/2006 | Silverbrook | |
| 7,051,426 | B2 * | 5/2006 | Buswell | 29/611 |
| 7,118,193 | B2 | 10/2006 | Kaneko et al. | |

(Continued)

FOREIGN PATENT DOCUMENTS

| | | |
|---|---|---|
| JP | 55101466 | 8/1980 |

(Continued)

OTHER PUBLICATIONS

European Search Report mailed Jun. 22, 2010; 6 pages.

*Primary Examiner*—Ahn T. N. Vo

(57) ABSTRACT

A fluid manifold for a fluid ejection device including a plurality of fluid feed slots includes a first layer and a second layer adjacent the first layer, and a first fluid routing and a second fluid routing each provided through the first layer and the second layer. The fluid ejection device is supported by the second layer, and the first fluid routing is communicated with one of the fluid feed slots, and the second fluid routing is communicated with an adjacent one of the fluid feed slots. A pitch of the first fluid routing and the second fluid routing through the first layer is greater than a pitch of the fluid feed slots, and the first fluid routing and the second fluid routing each include a first channel oriented substantially parallel with the fluid feed slots and a second channel oriented substantially perpendicular to the fluid feed slots.

22 Claims, 5 Drawing Sheets

U.S. PATENT DOCUMENTS

| | | | |
|---|---|---|---|
| 7,152,938 | B2 | 12/2006 | Silverbrook et al. |
| 2002/0008732 | A1 | 1/2002 | Moon et al. |
| 2004/0160494 | A1 | 8/2004 | Isono et al. |
| 2005/0179732 | A1 | 8/2005 | Sato et al. |
| 2006/0001704 | A1 | 1/2006 | Anderson et al. |
| 2006/0214978 | A1 | 9/2006 | Takagi |

FOREIGN PATENT DOCUMENTS

| | | | |
|---|---|---|---|
| JP | 07060958 | A | 3/1995 |

* cited by examiner

FLUID MANIFOLD FOR FLUID EJECTION DEVICE

BACKGROUND

An inkjet printing system, as one embodiment of a fluid ejection system, may include a printhead, an ink supply which supplies liquid ink to the printhead, and an electronic controller which controls the printhead. The printhead, as one embodiment of a fluid ejection device, ejects drops of ink through a plurality of nozzles or orifices and toward a print medium, such as a sheet of paper, so as to print onto the print medium. Typically, the orifices are arranged in one or more columns or arrays such that properly sequenced ejection of ink from the orifices causes characters or other images to be printed upon the print medium as the printhead and the print medium are moved relative to each other.

The printhead may include one or more ink feed slots which route different colors or types of ink to fluid ejection chambers communicated with the nozzles or orifices of the printhead. Due to market forces and continuing technological improvements, the spacing or width between the ink feed slots (i.e., slot pitch) has been decreasing. This decrease in slot pitch, although increasing a number of nozzles or resolution of the printhead, may create a challenge for routing ink to the ink feed slots of the printhead.

For these and other reasons, there is a need for the present invention.

SUMMARY

One aspect of the present invention provides a fluid manifold for a fluid ejection device including a plurality of fluid feed slots. The fluid manifold includes a first layer and a second layer adjacent the first layer, and a first fluid routing and a second fluid routing each provided through the first layer and the second layer. As such, the fluid ejection device is supported by the second layer, and the first fluid routing is communicated with one of the fluid feed slots, and the second fluid routing is communicated with an adjacent one of the fluid feed slots. In addition, a pitch of the first fluid routing and the second fluid routing through the first layer is greater than a pitch of the fluid feed slots. Furthermore, the first fluid routing and the second fluid routing each include a first channel oriented substantially parallel with the fluid feed slots and a second channel oriented substantially perpendicular to the fluid feed slots.

DETAILED DESCRIPTION

In the following detailed description, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. Because components of embodiments of the present invention can be positioned in a number of different orientations, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
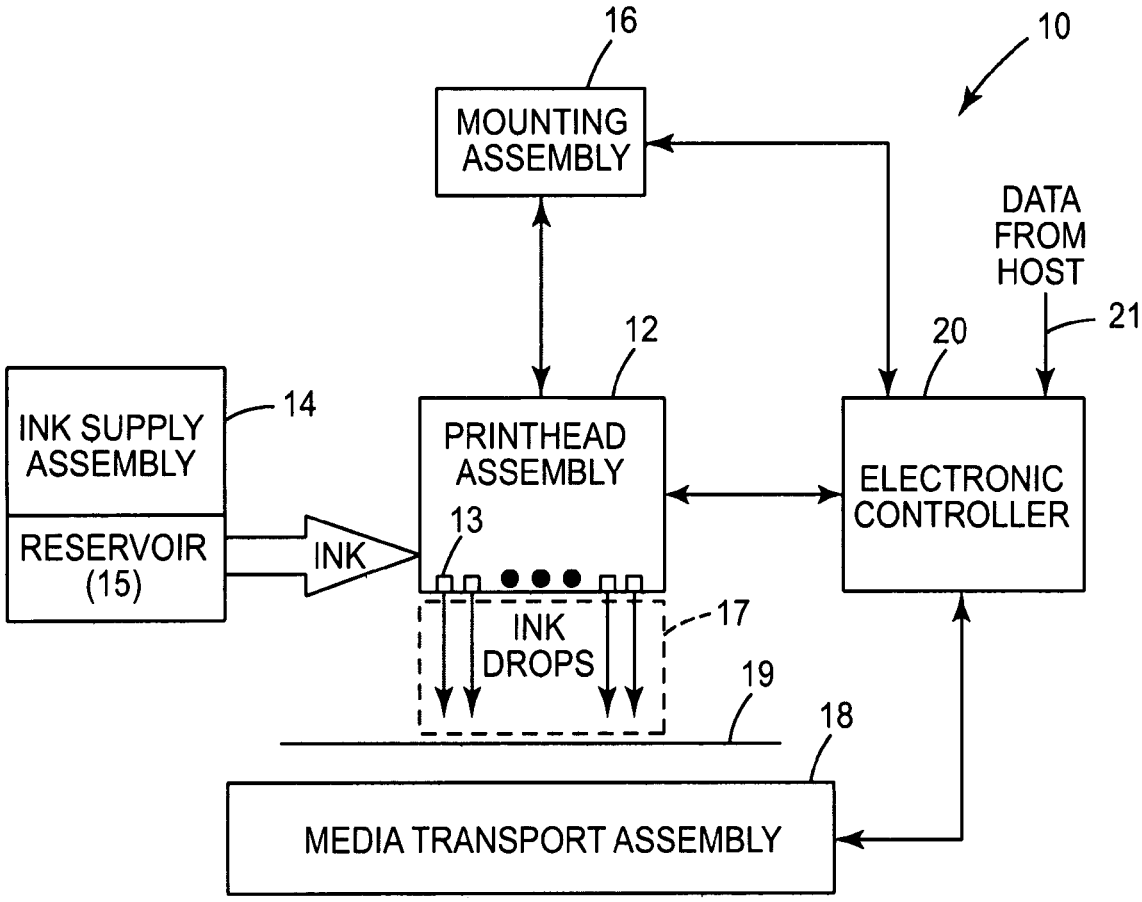
FIG. 1 is a block diagram illustrating one embodiment of a fluid ejection system.

FIG. 1 illustrates one embodiment of an inkjet printing system 10 according to the present invention. Inkjet printing system 10 constitutes one embodiment of a fluid ejection system which includes a fluid ejection assembly, such as a printhead assembly 12, and a fluid supply, such as an ink supply assembly 14. In the illustrated embodiment, inkjet printing system 10 also includes a mounting assembly 16, a media transport assembly 18, and an electronic controller 20.

Printhead assembly 12, as one embodiment of a fluid ejection assembly, is formed according to an embodiment of the present invention and ejects drops of ink, including one or more colored inks, through a plurality of orifices or nozzles 13. While the following description refers to the ejection of ink from printhead assembly 12, it is understood that other liquids, fluids, or flowable materials may be ejected from printhead assembly 12.

In one embodiment, the drops are directed toward a medium, such as print media 19, so as to print onto print media 19. Typically, nozzles 13 are arranged in one or more columns or arrays such that properly sequenced ejection of ink from nozzles 13 causes, in one embodiment, characters, symbols, and/or other graphics or images to be printed upon print media 19 as printhead assembly 12 and print media 19 are moved relative to each other.

Print media 19 includes, for example, paper, card stock, envelopes, labels, transparent film, cardboard, rigid panels, and the like. In one embodiment, print media 19 is a continuous form or continuous web print media 19. As such, print media 19 may include a continuous roll of unprinted paper.

Ink supply assembly 14, as one embodiment of a fluid supply, supplies ink to printhead assembly 12 and includes a reservoir 15 for storing ink. As such, ink flows from reservoir 15 to printhead assembly 12. In one embodiment, ink supply assembly 14 and printhead assembly 12 form a recirculating ink delivery system. As such, ink flows back to reservoir 15 from printhead assembly 12. In one embodiment, printhead assembly 12 and ink supply assembly 14 are housed together in an inkjet print cartridge or pen, as identified by dashed line 30. In another embodiment, ink supply assembly 14 is separate from printhead assembly 12 and supplies ink to printhead assembly 12 through an interface connection, such as a supply tube (not shown).

Mounting assembly 16 positions printhead assembly 12 relative to media transport assembly 18, and media transport assembly 18 positions print media 19 relative to printhead assembly 12. As such, a print zone 17 within which printhead assembly 12 deposits ink drops is defined adjacent to nozzles 13 in an area between printhead assembly 12 and print media 19. During printing, print media 19 is advanced through print zone 17 by media transport assembly 18.

In one embodiment, printhead assembly 12 is a scanning type printhead assembly, and mounting assembly 16 moves printhead assembly 12 relative to media transport assembly 18 and print media 19 during printing of a swath on print media 19. In another embodiment, printhead assembly 12 is a non-scanning type printhead assembly, and mounting assembly 16 fixes printhead assembly 12 at a prescribed position relative to media transport assembly 18 during printing of a swath on print media 19 as media transport assembly 18 advances print media 19 past the prescribed position.

Electronic controller 20 communicates with printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical or other information transfer path. Data 21 represents, for example, a document and/or file to be printed. As such, data 21 forms a print job for inkjet printing system 10 and includes one or more print job commands and/or command parameters.

In one embodiment, electronic controller 20 provides control of printhead assembly 12 including timing control for ejection of ink drops from nozzles 13. As such, electronic controller 20 defines a pattern of ejected ink drops which form characters, symbols, and/or other graphics or images on print media 19. Timing control and, therefore, the pattern of ejected ink drops, is determined by the print job commands and/or command parameters. In one embodiment, logic and drive circuitry forming a portion of electronic controller 20 is located on printhead assembly 12. In another embodiment, logic and drive circuitry forming a portion of electronic controller 20 is located off printhead assembly 12.

Figure 2:
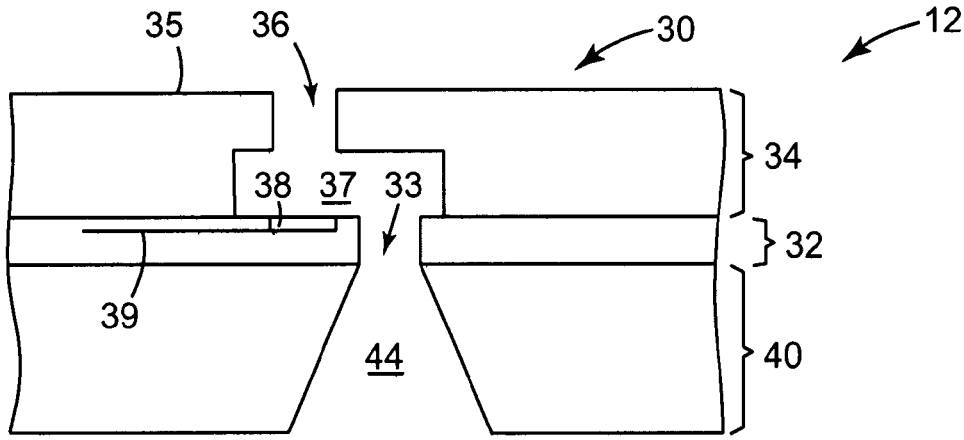
FIG. 2 is a schematic cross-sectional view illustrating one embodiment of a portion of a fluid ejection device.

FIG. 2 illustrates one embodiment of a portion of printhead assembly 12. Printhead assembly 12, as one embodiment of a fluid ejection assembly, includes one or more fluid ejection devices 30. Fluid ejection device 30 is formed on a substrate 40 which has a fluid (or ink) feed slot 44 formed therein. As such, fluid feed slot 44 provides a supply of fluid (or ink) to fluid ejection device 30.

In one embodiment, fluid ejection device 30 includes a thin-film structure 32, an orifice layer 34, and a firing resistor 38. Thin-film structure 32 has a fluid (or ink) feed channel 33 formed therein which communicates with fluid feed slot 44 of substrate 40. Orifice layer 34 has a front face 35 and a nozzle opening 36 formed in front face 35. Orifice layer 34 also has a nozzle chamber 37 formed therein which communicates with nozzle opening 36 and fluid feed channel 33 of thin-film structure 32. Firing resistor 38 is positioned within nozzle chamber 37 and includes leads 39 which electrically couple firing resistor 38 to a drive signal and ground.

In one embodiment, during operation, fluid flows from fluid feed slot 44 to nozzle chamber 37 via fluid feed channel 33. Nozzle opening 36 is operatively associated with firing resistor 38 such that droplets of fluid are ejected from nozzle chamber 37 through nozzle opening 36 (e.g., normal to the plane of firing resistor 38) and toward a medium upon energization of firing resistor 38.

Example embodiments of printhead assembly 12 include a thermal printhead, a piezoelectric printhead, a flex-tensional printhead, or any other type of fluid ejection device known in the art. In one embodiment, printhead assembly 12 is a fully integrated thermal inkjet printhead. As such, substrate 40 is formed, for example, of silicon, glass, or a stable polymer, and thin-film structure 32 is formed by one or more layers of silicon dioxide, silicon carbide, silicon nitride, silicon oxide, tantalum, poly-silicon, or other suitable material forming one or more passivation, insulation, or cavitation layers. Thin-film structure 32 also includes a conductive layer which defines firing resistor 38 and leads 39. The conductive layer is formed, for example, by aluminum, gold, tantalum, tantalum-aluminum, or other metal or metal alloy.

Figure 3:
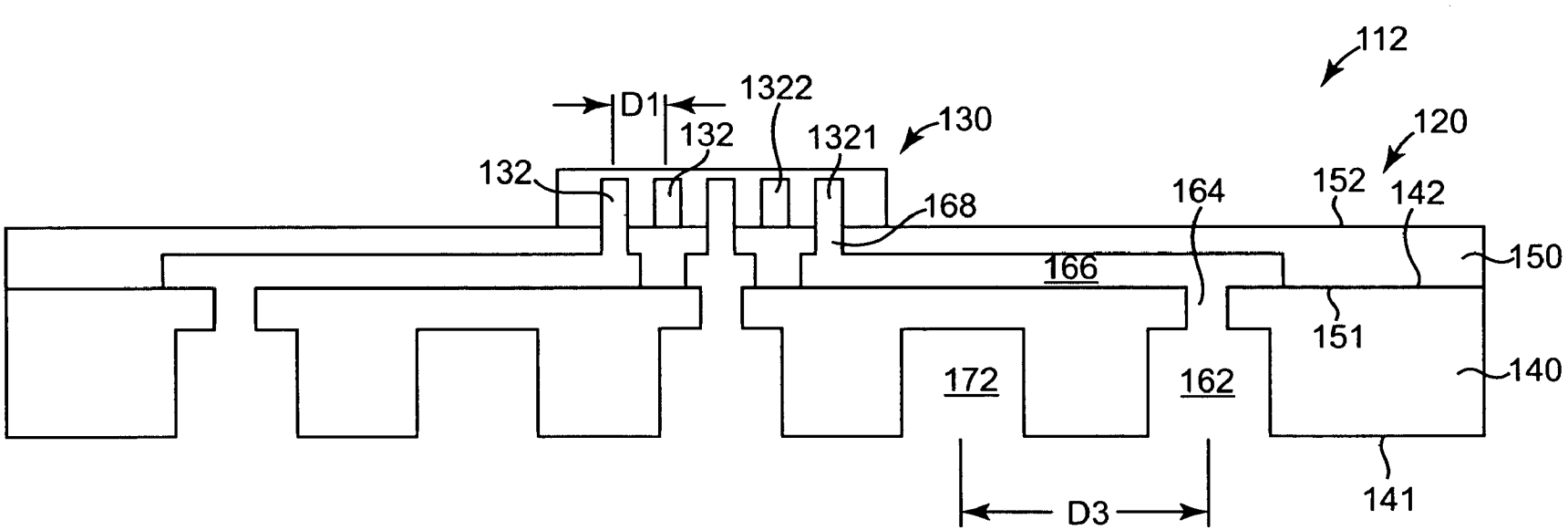
FIG. 3 is a schematic cross-sectional view illustrating one embodiment of a fluid manifold for a fluid ejection device.

FIG. 3 illustrates another embodiment of a portion of printhead assembly 12. Printhead assembly 112, as another embodiment of a fluid ejection assembly, includes a fluid manifold 120 and a fluid ejection device 130 mounted on fluid manifold 120. Fluid ejection device 130 is mounted on fluid manifold 120 such that fluid manifold 120 provides mechanical support for fluid ejection device 130 and fluidic routing to fluid ejection device 130.

In one embodiment, fluid manifold 120 includes a first layer 140 and a second layer 150. In one embodiment, first layer 140 and second layer 150 are joined together such that second layer 150 is adjacent first layer 140. First layer 140 has a first side 141 and a second side 142, and second layer 150 has a first side 151 and a second side 152. Second side 142 of first layer 140 is opposite of first side 141 of first layer 140 and, in one embodiment, oriented substantially parallel with first side 141, and second side 152 of second layer 150 is opposite of first side 151 of second layer 150 and, in one embodiment, oriented substantially parallel with first side 151. In one embodiment, first layer 140 and second layer 150 are joined together such that first side 151 of second layer 150 is adjacent second side 142 of first layer 140.

In one embodiment, fluid ejection device 130 is supported by or mounted on second layer 150 of fluid manifold 120. More specifically, fluid ejection device 130 is supported by or mounted on second side 152 of second layer 150. In one embodiment, fluid ejection device 130 includes a plurality of fluid feed slots 132 each configured similar to fluid feed slot 44 of fluid ejection device 30 (FIG. 2). In one embodiment, as described below, fluid ejection device 130 is supported by or mounted on fluid manifold 120 such that fluid manifold 120 communicates or supplies fluid to fluid feed slots 132.

Figure 4:
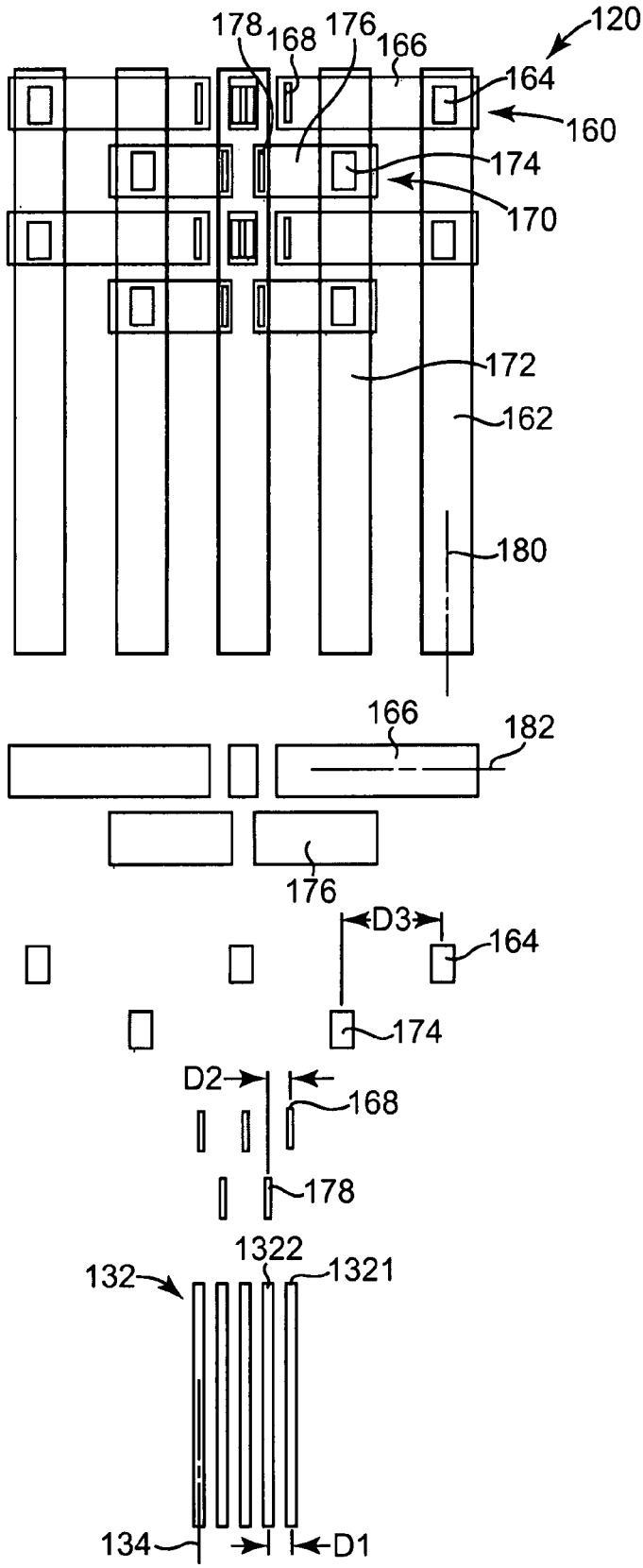
FIG. 4 is a schematic plan view illustrating one embodiment of a layout of a fluid manifold for a fluid ejection device.

In one embodiment, as illustrated in FIGS. 3 and 4, fluid manifold 120 provides fluid routing or pathways to fluid feed slots 132 of fluid ejection device 130. More specifically, fluid manifold 120 provides separate or isolated fluid routing or pathways to each fluid feed slot 132 of fluid ejection device 130. For example, a first fluid routing 160 is provided to a first fluid feed slot 1321, and a second fluid routing 170 is provided to a second fluid feed slot 1322. As illustrated in FIGS. 3 and 4, additional fluid routings or pathways are or may be provided to additional fluid feed slots 132 of fluid ejection device 130.

Fluid routing 160 and fluid routing 170 are provided or formed through first layer 140 and second layer 150 of fluid manifold 120. More specifically, fluid routing 160 and fluid routing 170 are each formed through and communicate with first side 141 and second side 142 of first layer 140, and first side 151 and second side 152 of second layer 150. As such, fluid routing 160 and fluid routing 170 each communicate with and provide fluidic routing between first side 141 of first layer 140 and second side 152 of second layer 150.

In one embodiment, as illustrated in FIGS. 3 and 4, fluid routing 160 includes a first channel 162, a first hole 164, a second channel 166, and a second hole 168, and fluid routing 170 includes a first channel 172, a first hole 174, a second channel 176, and a second hole 178. In one embodiment, first channel 162, first hole 164, second channel 166, and second hole 168 of fluid routing 160 communicate with each other to provide fluidic routing through first layer 140 and second layer 150, and first channel 172, first hole 174, second channel 176, and second hole 178 of fluid routing 170 communicate with each other to provide fluidic routing through first layer 140 and second layer 150. For example, second channel 166 of fluid routing 160 extends between and communicates with first hole 164 and second hole 168 of fluid routing 160, and second channel 176 of fluid routing 170 extends between and communicates with first hole 174 and second hole 178 of fluid routing 170.

In one embodiment, first channel 162 of fluid routing 160 and first channel 172 of fluid routing 170 are formed in and communicate with first side 141 of first layer 140, and first hole 164 of fluid routing 160 and first hole 174 of fluid routing 170 are formed in and communicate with second side 142 of first layer 140. In addition, second channel 166 of fluid routing 160 and second channel 176 of fluid routing 170 are formed in and communicate with first side 151 of second layer 150, and second hole 168 of fluid routing 160 and second hole 178 of fluid routing 170 are formed in and communicate with second side 152 of second layer 150.

In one embodiment, first channel 162 of fluid routing 160 and first channel 172 of fluid routing 170 each extend and are oriented substantially parallel with fluid feed slots 132 of fluid ejection device 130. More specifically, first channel 162 of fluid routing 160 and first channel 172 of fluid routing 170 each extend along a longitudinal axis 180 oriented substantially parallel with a longitudinal axis 134 of fluid feed slots 132. As such, first channel 162 of fluid routing 160 and first channel 172 of fluid routing 170 form longitudinal channels of fluid manifold 120. In one embodiment, first channel 162 of fluid routing 160 and first channel 172 of fluid routing 170 each extend the length of fluid feed slots 132.

In one embodiment, second channel 166 of fluid routing 160 and second channel 176 of fluid routing 170 each extend and are oriented substantially perpendicular to fluid feed slots 132 of fluid ejection device 130. More specifically, second channel 166 of fluid routing 160 and second channel 176 of fluid routing 170 each extend along a lateral axis 182 oriented substantially perpendicular to longitudinal axis 134 of fluid feed slots 132. As such, second channel 166 of fluid routing 160 and second channel 176 of fluid routing 170 form lateral channels of fluid manifold 120.

In one embodiment, fluid manifold 120 accommodates different spacing between fluid routing at opposite sides of fluid manifold 120. More specifically, fluid manifold 120 accommodates different spacing between fluid routing at first side 141 of first layer 140 and second side 152 of second layer 150. In one embodiment, for example, fluid manifold 120 accommodates a narrower spacing of fluid feed slots 132 of fluid ejection device 130, as supported on second side 152 of second layer 150, and provides a wider spacing of fluid routing 160 and fluid routing 170 at first side 141 of first layer 140.

In one exemplary embodiment, fluid feed slots 132 of fluid ejection device 130 have a spacing or a pitch D1. In addition, second hole 168 of fluid routing 160 and second hole 178 of fluid routing 170 at second side 152 of second layer 150 have a spacing or pitch D2, and first hole 164 of fluid routing 160 and first hole 174 of fluid routing 170 at first side 141 of first layer 140 have a spacing or pitch D3. To accommodate fluid feed slots 132 of fluid ejection device 130, spacing or pitch D2 of fluid routing 160 and fluid routing 170 at second side 152 of second layer 150 is substantially equal to spacing or pitch D1 of fluid feed slots 132 of fluid ejection device 130. Spacing or pitch D3 of fluid routing 160 and fluid routing 170 at first side 141 of first layer 140, however, is greater than spacing or pitch D2 of fluid routing 160 and fluid routing 170 at second side 152 of second layer 150. Spacing or pitch D3 of fluid routing 160 and fluid routing 170 at first side 141 of first layer 140, therefore, is greater than spacing or pitch D1 of fluid feed slots 132 of fluid ejection device 130. As such, fluid manifold 120 accommodates the narrower spacing of fluid feed slots 132 of fluid ejection device 130, and provides the wider spacing of fluid routing 160 and fluid routing 170 at first side 141 of first layer 140.

FIGS. 5A-5E illustrate one embodiment of forming fluid manifold 120. Although the following description is directed to forming fluid routing 160 of fluid manifold 120, it is understood that fluid routing 170 or other fluid routings of fluid manifold 120 are or may also be formed with fluid routing 160. In one embodiment, first layer 140 and second layer 150 are formed of silicon, and first channel 162, first hole 164, second channel 166, and second hole 168 of fluid routing 160 are formed in first layer 140 and second layer 150 by chemical etching and/or machining, as described below.

Figure 5A:
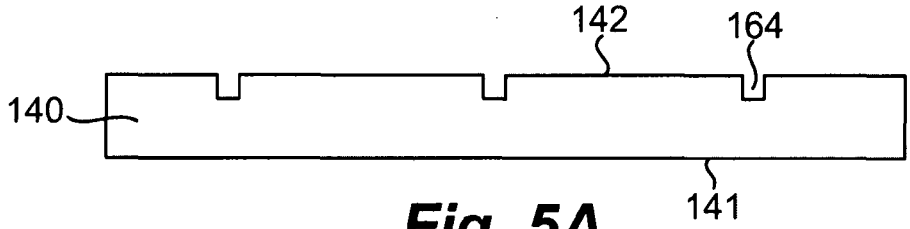
FIGS. 5A-5E illustrate one embodiment of forming a fluid manifold for a fluid ejection device.

As illustrated in the embodiment of FIG. 5A, first hole 164 of fluid routing 160 is formed in first layer 140. More specifically, first hole 164 is formed in second side 142 of first layer 140. In one embodiment, first hole 164 is formed in first layer 140 by photolithography and etching. In one exemplary embodiment, first hole 164 is formed in first layer 140 by a dry etch process.

Figure 5B:
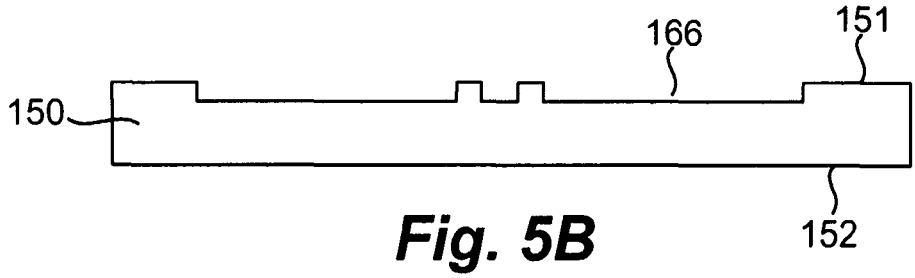

As illustrated in the embodiment of FIG. 5B, second channel 166 of fluid routing 160 is formed in second layer 150. More specifically, second channel 166 is formed in first side 151 of second layer 150. In one embodiment, second channel 166 is formed in second layer 150 by photolithography and etching. In one exemplary embodiment, second channel 166 is formed in second layer 150 by a dry etch process.

Figure 5C:
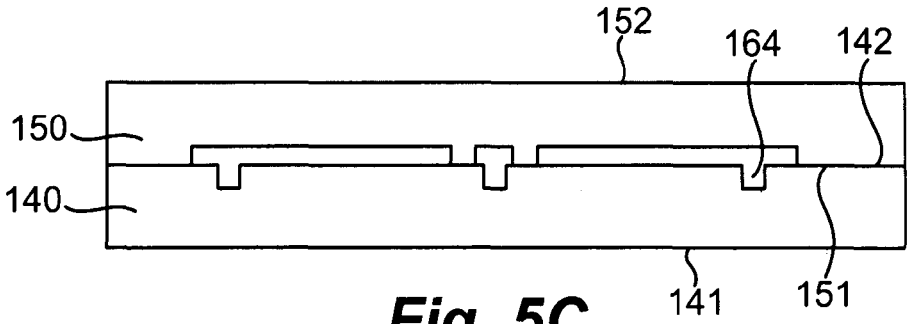

As illustrated in the embodiment of FIG. 5C, after first hole 164 is formed in first layer 140 and second channel 166 is formed in second layer 150, first layer 140 and second layer 150 are joined together. More specifically, second layer 150 is flipped and oriented such that first side 151 of second layer 150 contacts second side 142 of first layer 140. In one exemplary embodiment, first layer 140 and second layer 150 are joined or bonded together using a direct bonding technique.

Figure 5D:
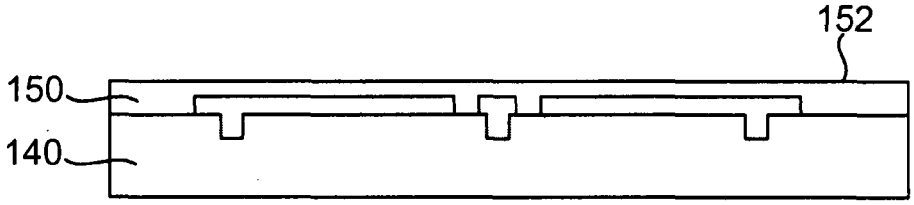

In one embodiment, as illustrated in FIG. 5D, second side 152 of second layer 150 is planarized to create a substantially flat surface on second side 152. In one exemplary embodiment, second side 152 of second layer 150 is planarized by a chemical mechanical polishing (CMP) process.

Figure 5E:
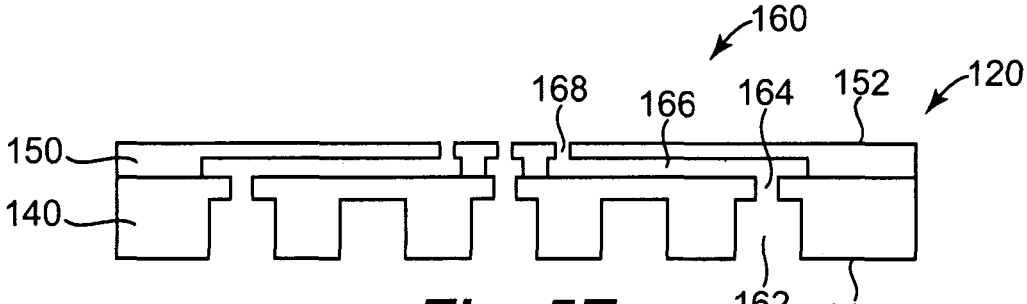

Next, as illustrated in the embodiment of FIG. 5E, second hole 168 of fluid routing 160 is formed in second layer 150, and first channel 162 of fluid routing 160 is formed in first layer 140. More specifically, second hole 168 is formed in second side 152 of second layer 150, and first channel 162 is formed in first side 141 of first layer 140. As such, fluid routing 160 including first channel 162, first hole 164, second channel 166, and second hole 168 is formed through first layer 140 and second layer 150.

In one embodiment, second hole 168 is formed in second layer 150 by photolithography and etching, and first channel 162 is formed in first layer 140 by machining. In one exemplary embodiment, second hole 168 is formed in second layer 150 by a dry etch process, and first channel 162 is formed in first layer 140 using a saw plunge cut technique.

Figure 6A:
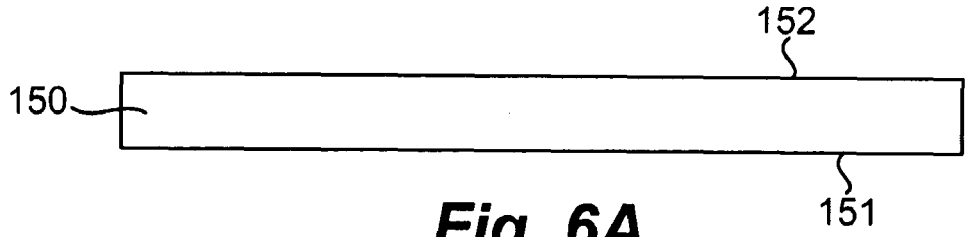
FIGS. 6A-6E illustrate another embodiment of forming a fluid manifold for a fluid ejection device.

FIGS. 6A-6E illustrate another embodiment of forming fluid manifold 120. As illustrated in the embodiment of FIG. 6A, first side 151 and second side 152 of second layer 150 are planarized to create substantially flat surfaces on first side 151 and second side 152. In one exemplary embodiment, first side 151 and second side 152 of second layer 150 are planarized using a CMP process.

Figure 6B:
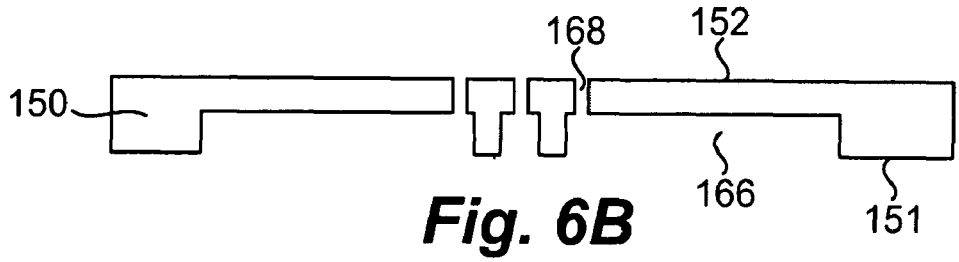

Next, as illustrated in the embodiment of FIG. 6B, second hole 168 of fluid routing 160 and second channel 166 of fluid routing 160 are formed in second layer 150. More specifically, second hole 168 is formed in second side 152 of second layer 150, and second channel 166 is formed in first side 151 of second layer 150. In one exemplary embodiment, second hole 168 is formed in second layer 150 by photolithography and etching, and second channel 166 is formed in second layer 150 by photolithography and etching.

Figure 6C:
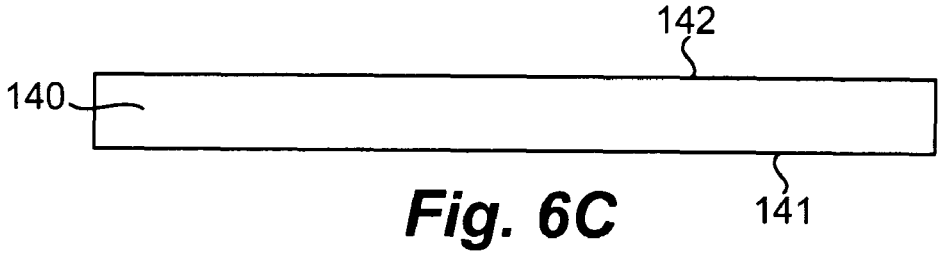

As illustrated in the embodiment of FIG. 6C, first side 141 and second side 142 of first layer 140 are planarized to create substantially flat surfaces on first side 141 and second side 142. In one exemplary embodiment, first side 141 and second side 142 of first layer 140 are planarized using a CMP process.

Figure 6D:
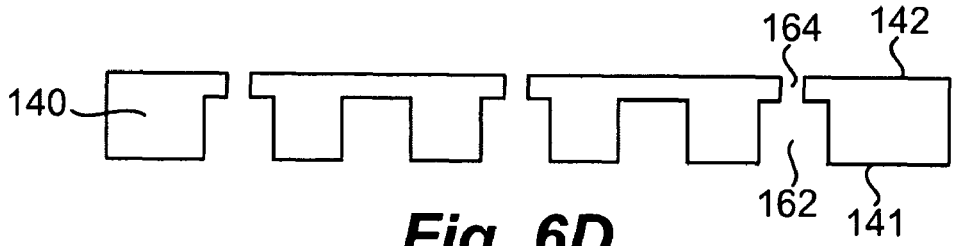

Next, as illustrated in the embodiment of FIG. 6D, first hole 164 of fluid routing 160 and first channel 162 of fluid routing 160 are formed in first layer 140. More specifically, first hole 164 is formed in second side 142 of first layer 140 and first channel 162 is formed in first side 141 of first layer 140. In one exemplary embodiment, first hole 164 is formed in first layer 140 by photolithography and etching, and first channel 162 is formed in first layer 140 by photolithography and etching.

Figure 6E:
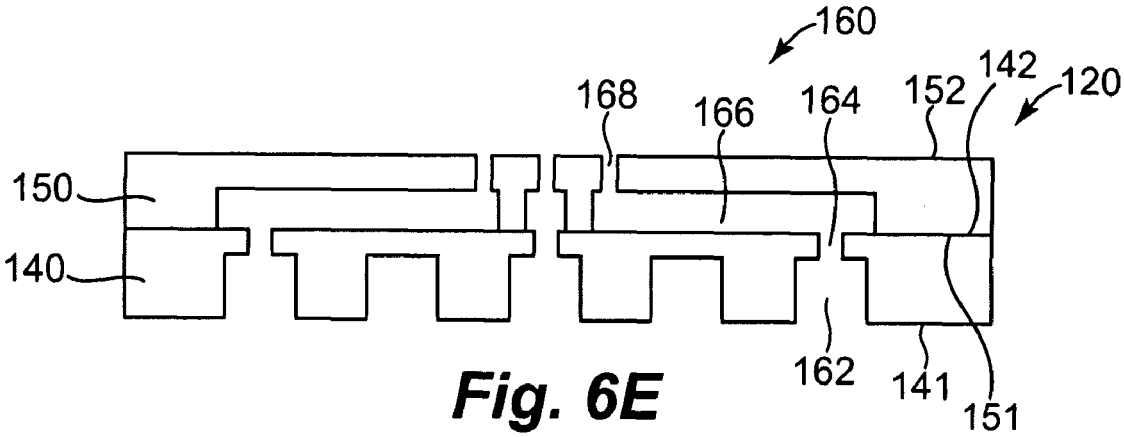

As illustrated in the embodiment of FIG. 6E, after first hole 164 and first channel 162 are formed in first layer 140, and second hole 168 and second channel 166 are formed in second layer 150, first layer 140 and second layer 150 are joined together. More specifically, first layer 140 and second layer 150 are oriented and joined together such that first side 151 of second layer 150 contacts second side 142 of first layer 140. In one exemplary embodiment, first layer 140 and second layer 150 are joined or bonded together using a direct bonding technique. As such, fluid routing 160 including first channel 162, first hole 164, second channel 166, and second hole 168 is formed through first layer 140 and second layer 150.

As described above, fluid manifold 120 accommodates a different spacing or pitch between fluid routing at opposite sides of fluid manifold 120. More specifically, fluid manifold 120 accommodates a narrower spacing of fluid feed slots 132 of fluid ejection device 130, as supported on second side 152 of second layer 150, and provides a wider spacing of fluid routing 160 and fluid routing 170 at first side 141 of first layer 140. As such, fluid manifold 120 provides a fan-out structure for fluid ejection device 130 whereby fluid ejection device 130 may be mounted on one side of fluid manifold 120, and a fluid reservoir or other body may be provided or mounted on an opposite side of fluid manifold 120.

Although specific embodiments have been illustrated and described herein, it will be appreciated by those of ordinary skill in the art that a variety of alternate and/or equivalent implementations may be substituted for the specific embodiments shown and described without departing from the scope of the present invention. This application is intended to cover any adaptations or variations of the specific embodiments discussed herein. Therefore, it is intended that this invention be limited only by the claims and the equivalents thereof.

What is claimed is:

1. A fluid manifold for a fluid ejection device including a plurality of fluid feed slots, the fluid manifold comprising:

a first layer and a second layer adjacent the first layer; and a first fluid routing and a second fluid routing each provided through the first layer and the second layer, wherein the fluid ejection device is supported by the second layer, and the first fluid routing is communicated with one of the fluid feed slots, and the second fluid routing is communicated with an adjacent one of the fluid feed slots, wherein a pitch of the first fluid routing and the second fluid routing through the first layer is greater than a pitch of the fluid feed slots, and wherein the first fluid routing and the second fluid routing each include a first channel oriented substantially parallel with the fluid feed slots and a second channel oriented substantially perpendicular to the fluid feed slots, wherein the first channel of each the first fluid routing and the second fluid routing is provided in the first layer, and the second channel of each the first fluid routing and the second fluid routing is provided in the second layer.

2. The fluid manifold of claim 1, wherein the first layer and the second layer each have a first side and a second side opposite the first side, wherein the first side of the second layer is adjacent the second side of the first layer.

3. The fluid manifold of claim 2, wherein the first fluid routing and the second fluid routing each communicate with the first side of the first layer and the second side of the second layer, and wherein a pitch of the first fluid routing and the second fluid routing at the first side of the first layer is greater than a pitch of the first fluid routing and the second fluid routing at the second side of the second layer.

4. The fluid manifold of claim 1, wherein the first fluid routing and the second fluid routing each further include a first hole communicated with the first channel, and a second hole communicated with the second channel, wherein the first hole of each the first fluid routing and the second fluid routing is provided in the first layer, and the second hole of each the first fluid routing and the second fluid routing is provided in the second layer.

5. The fluid manifold of claim 4, wherein the second channel of the first fluid routing is communicated with the first channel of the first fluid routing via the first hole of the first fluid routing, and the second channel of the second fluid routing is communicated with the first channel of the second fluid routing via the first hole of the second fluid routing.

6. The fluid manifold of claim 4, wherein the second hole of the first fluid routing is communicated with the one of the fluid feed slots, and the second hole of the second fluid routing is communicated with the adjacent one of the fluid feed slots.

7. The fluid manifold of claim 4, wherein a pitch of the first hole of the first fluid routing and the second fluid routing is greater than a pitch of the second hole of the first fluid routing and the second fluid routing.

8. The fluid manifold of claim 1, wherein the second channel of the first fluid routing includes a plurality of second channels each communicated with the first channel of the first fluid routing, and the second channel of the second fluid routing includes a plurality of second channels each communicated with the first channel of the second fluid routing.

9. A fluid manifold for a fluid ejection device including a plurality of fluid feed slots, the fluid manifold comprising:

a first layer;

a second layer adjacent the first layer;

first means for routing fluid through the first layer and the second layer; and second means for routing fluid through the first layer and the second layer, wherein the fluid ejection device is supported by the second layer, and the first means for routing fluid routes fluid to one of the fluid feed slots, and the second means for routing fluid routes fluid to an adjacent one of the fluid feed slots, wherein a pitch of the first means for routing fluid and the second means for routing fluid at the first layer is greater than a pitch of the fluid feed slots, and wherein the first means for routing fluid and the second means for routing fluid each include means for routing fluid substantially parallel with the fluid feed slots, and means for routing fluid substantially perpendicular to the fluid feed slots wherein the means for routing fluid substantially parallel with the fluid feed slots is provided in the first layer, and the means for routing fluid substantially perpendicular to the fluid feed slots is provided in the second layer.

10. The fluid manifold of claim 9, wherein the first layer and the second layer each have a first side and a second side opposite the first side, wherein the first side of the second layer is adjacent the second side of the first layer.

11. The fluid manifold of claim 10, wherein the first means for routing fluid through the first layer and the second layer and the second means for routing fluid through the first layer and the second layer each communicate with the first side of the first layer and the second side of the second layer, and wherein a pitch of the first means for routing fluid and the second means for routing fluid at the first side of the first layer is greater than a pitch of the first means for routing fluid and the second means for routing fluid at the second side of the second layer.

12. The fluid manifold of claim 9, wherein, with the first means for routing through the first layer and the second layer, the means for routing fluid substantially parallel with the fluid feed slots communicates with the means for routing fluid substantially perpendicular to the fluid feed slots, and wherein, with the second means for routing fluid through the first layer and the second layer, the means for routing fluid substantially parallel with the fluid feed slots communicates with the means for routing fluid substantially perpendicular to the fluid feed slots.

13. A method of forming a fluid manifold for a fluid ejection device including a plurality of fluid feed slots, the method comprising:

positioning a first layer adjacent a second layer; and providing a first fluid routing and a second fluid routing through the first layer and the second layer, wherein the fluid ejection device is supported by the second layer, and providing the first fluid routing and the second fluid routing includes communicating the first fluid routing with one of the fluid feed slots and communicating the second fluid routing with an adjacent one of the fluid feed slots, wherein providing the first fluid routing and the second fluid routing include defining a pitch of the first fluid routing and the second fluid routing through the first layer as being greater than a pitch of the fluid feed slots, and wherein providing the first fluid routing and the second fluid routing includes orienting a first channel of each of the first fluid routing and the second fluid routing substantially parallel with the fluid feed slots, and orienting a second channel of each of the first fluid routing and the second fluid routing substantially perpendicular to the fluid feed slots, wherein providing the first fluid routing and the second fluid routing through the first layer and the second layer includes defining the first channel of each the first fluid routing and the second fluid routing in the first layer, and defining the second channel of each the first fluid routing and the second fluid routing in the second layer.

14. The method of claim 13, wherein the first layer and the second layer each have a first side and a second side opposite the first side, wherein positioning the first layer adjacent the second layer includes positioning the first side of the second layer adjacent the second side of the first layer.

15. The method of claim 14, wherein providing the first fluid routing and the second fluid routing through the first layer and the second layer includes communicating each the first fluid routing and the second fluid routing with the first side of the first layer and the second side of the second layer, and defining a pitch of the first fluid routing and the second fluid routing at the first side of the first layer as being greater than a pitch of the first fluid routing and the second fluid routing at the second side of the second layer.

16. The method of claim 13, wherein providing the first fluid routing and the second fluid routing through the first layer and the second layer further includes communicating a first hole with the first channel of each the first fluid routing and the second fluid routing, including defining the first hole of each the first fluid routing and the second fluid routing in the first layer, and communicating a second hole with the second channel of each the first fluid routing and the second fluid routing, including defining the second hole of each the first fluid routing and the second fluid routing in the second layer.

17. The method of claim 16, wherein providing the first fluid routing and the second fluid routing through the first layer and the second layer includes communicating the second channel of the first fluid routing with the first channel of the first fluid routing via the first hole of the first fluid routing, and communicating the second channel of the second fluid routing with the first channel of the second fluid routing via the first hole of the second fluid routing.

18. The method of claim 16, wherein providing the first fluid routing and the second fluid routing through the first layer and the second layer includes communicating the second hole of the first fluid routing with the one of the fluid feed slots, and communicating the second hole of the second fluid routing with the adjacent one of the fluid feed slots.

19. The method of claim 16, wherein defining the first hole of each the first fluid routing and the second fluid routing in the first layer and defining the second hole of each the first fluid routing and the second fluid routing in the second layer includes defining a pitch of the first hole of the first fluid routing and the second fluid routing as being greater than a pitch of the second hole of the first fluid routing and the second fluid routing.

20. The method of claim 13, wherein orienting the second channel of each of the first fluid routing and the second fluid routing substantially perpendicular to the fluid feeds slots includes communicating a plurality of second channels with the first channel of the first fluid routing, and communicating a plurality of second channels with the first channel of the second fluid routing.

21. A fluid manifold for a fluid ejection device including a plurality of fluid feed slots, the fluid manifold comprising:

a multi-layer assembly having a first side and a second side opposite the first side; and a first fluid routing and a second fluid routing each provided through the multi-layer assembly and communicated with the first side and the second side, wherein the fluid ejection device is supported by the second side of the multi-layer assembly, and the first fluid routing is communicated with one of the fluid feed slots, and the second fluid routing is communicated with an adjacent one of the fluid feed slots, wherein a pitch of the first fluid routing and the second fluid routing at the first side of the multi-layer assembly is greater than a pitch of the fluid feed slots, and wherein the first fluid routing and the second fluid routing each include a first channel oriented substantially parallel with the fluid feed slots and a second channel oriented substantially perpendicular to the fluid feed slots, wherein the second channel is fluidly intermediate the first channel and a respective one of the fluid feed slots.

22. The fluid manifold of claim 21, wherein the first channel of each of the first fluid routing and the second fluid routing is provided in one layer of the multi-layer assembly, and the second channel of each of the first fluid routing and the second fluid routing is provided in another layer of the multi-layer assembly, wherein the another layer of the multi-layer assembly is adjacent the one layer of the multi-layer assembly, and wherein the fluid ejection device is supported by the another layer of the multi-layer assembly.

* * * * *

UNITED STATES PATENT AND TRADEMARK OFFICE

CERTIFICATE OF CORRECTION

PATENT NO. : 7,874,654 B2
APPLICATION NO. : 11/818314
DATED : January 25, 2011
INVENTOR(S) : Eric L. Nikkel et al.

It is certified that error appears in the above-identified patent and that said Letters Patent is hereby corrected as shown below:

In column 8, line 3, in Claim 1, delete "of each the" and insert -- of each of the --, therefor.

In column 8, line 5, in Claim 1, delete "of each the" and insert -- of each of the --, therefor.

In column 8, line 22, in Claim 4, delete "of each the" and insert -- of each of the --, therefor.

In column 8, line 23, in Claim 4, delete "of each the" and insert -- of each of the --, therefor.

In column 8, line 67, in Claim 9, delete "slots" and insert -- slots, --, therefor.

In column 9, line 55, in Claim 13, delete "of each the" and insert -- of each of the --, therefor.

In column 9, line 57, in Claim 13, delete "of each the" and insert -- of each of the --, therefor.

In column 10, line 9, in Claim 16, delete "of each the" and insert -- of each of the --, therefor.

In column 10, line 11, in Claim 16, delete "of each the" and insert -- of each of the --, therefor.

In column 10, line 13, in Claim 16, delete "of each the" and insert -- of each of the --, therefor.

In column 10, line 14, in Claim 16, delete "of each the" and insert -- of each of the --, therefor.

In column 10, line 32, in Claim 19, delete "of each the" and insert -- of each of the --, therefor.

In column 10, line 33, in Claim 19, delete "of each the" and insert -- of each of the --, therefor.

Signed and Sealed this
Third Day of May, 2011

David J. Kappos

David J. Kappos
*Director of the United States Patent and Trademark Office*